United States Patent [19]

Baker

[11] 4,037,868

[45] July 26, 1977

[54] PICK UP APPARATUS

[76] Inventor: Robert M. Baker, R.F.D. No. 1, Morley, Mich. 49336

[21] Appl. No.: 652,297

[22] Filed: Jan. 26, 1976

[51] Int. Cl.[2] ..... B25J 1/00

[52] U.S. Cl. ..... 294/19 R; 294/104

[58] Field of Search ..... 294/8.5, 11, 19 R, 22, 294/23, 50.8, 50.9, 104, 115

[56] References Cited

U.S. PATENT DOCUMENTS

| | | | |
|---|---|---|---|
| 349,394 | 9/1886 | Heidt | 294/104 X |
| 1,624,442 | 4/1927 | Stastny | 294/50.9 |
| 1,694,525 | 12/1928 | Bloemsma | 294/11 |
| 1,910,725 | 5/1933 | Valenta | 294/11 |
| 1,976,977 | 10/1934 | Zinky | 294/104 X |
| 2,061,130 | 11/1936 | Balzer | 294/104 X |
| 2,436,500 | 2/1948 | Anderson | 294/50.8 |
| 2,720,409 | 10/1955 | Griffith | 294/19 R |
| 2,807,495 | 9/1957 | Pillstrom | 294/104 |
| 2,819,110 | 1/1958 | Redmon | 294/19 R |
| 3,265,429 | 8/1966 | Shatt | 294/104 X |
| 3,276,805 | 10/1966 | Lambert | 294/19 R |
| 3,591,226 | 7/1971 | Elmore et al. | 294/19 R |

*Primary Examiner*—Johnny D. Cherry

*Attorney, Agent, or Firm*—Price, Heneveld, Huizenga & Cooper

[57] ABSTRACT

A manually operated hand held pick up apparatus includes an elongated tubular shank having a handle at one end and a flattened fixed jaw member at the opposite end. A movable jaw member, having a width significantly wider than that of the fixed jaw member and concavely curved, is pivotally mounted to the shank near the opposite end and is movable between a jaw open and a jaw closed position. A control rod is coupled to the movable jaw at one end and to an actuating trigger near the handle. A bias spring coupled to the control rod holds the movable jaw in a normally open position. In one embodiment the tubular shank consists of a pair of telescopic tubes permitting adjustment of the length of the device.

6 Claims, 4 Drawing Figures

PICK UP APPARATUS

BACKGROUND OF THE INVENTION

The present invention relates to hand operated pick up devices and particularly to improved jaw construction for such devices.

There are a variety of known manually operated pick up devices used by, for example, government employees in picking up litter in public places such as parks, along road sides and the like. Many of these devices are of the spear type in which a piece of litter is impailed and subsequently removed in a litter bag. Additionally, several movable jaw-type pick up devices incorporating a combination of one movable jaw with a fixed jaw are known. See, for example, U.S. Pat. Nos. 3,254,028, issued to C. B. Rasmussen; 1,855,477, issued to F. R. Emery; and 1,271,149, issued to H. L. Ford as typical of movable jaw-type pick up devices.

With such prior art devices, typically the jaw members are constructed to perform a selected task which makes their universal use impractical. Thus, for example, the Rasmussen device employs rod-shaped jaws which are useful for picking up paper and cigarettes but can not operate efficiently in picking up larger objects such as cans, bottles and the like. The Emery device is specifically a weed puller using a duck billed jaw construction where the jaws are of equal width and do not open sufficiently to encompass a bottle or a can easily. The Ford device is particularly adapted for handling pieces of laundry and for that purpose includes jaw members of equal width and in one embodiment one of the jaws has a plurality of teeth.

The shortcomings of prior art devices represented by these patents lies in the inability for the jaws to universally handle a great variety of objects ranging from relatively small objects to larger objects such as bottles and cans as well as objects having a variety of shapes.

SUMMARY OF THE INVENTION

The apparatus of the present invention, however, overcomes the difficulties of the prior art by providing a unique jaw construction in which one of the jaw members is curved with a relatively flat cross section and having a first width, and a second jaw member is concavely curved and wider than the first member. Elongated objects, thus, will be held in a stable fashion between the two jaw members and relatively small objects are forced to the center portion of the jaws by the concavely curved member. The resultant pick up device is capable of picking up objects as small as pins, spherical objects, either large or small, and larger objects such as bottles and cans. Thus, the device utilizes a jaw construction for universal applications. These and other advantages of the present invention will become readily apparent to those skilled in the art upon reviewing the following description thereof together with the accompanying drawings in which:

DETAILED DESCRIPTION OF THE PREFERRED EMBODIMENT

Figure 1:
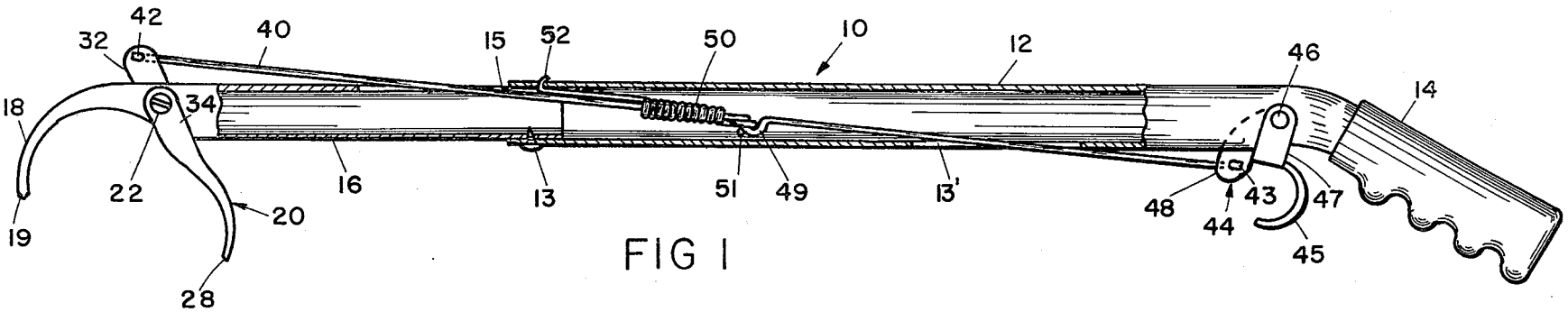
FIG. 1 is a side elevational view partly in cross section of a pick up device embodying the present invention.

Referring initially to FIG. 1, there is shown a pick up device 10 which includes a first tubular shank section 12 made of one inch (outer diameter) extruded aluminum tubing in the preferred embodiment and curved at one end to define a handle and accommodate a handle bar grip 14 such as is used on bicycles. Telescopically fitted within the first tubular shank segment 12 is a second tubular shank segment 16 comprising in the preferred embodiment a $\frac{7}{8}$ inch extruded aluminum tube. Tubes 12 and 16 are secured to one another by means of one or more screws 13. The end of tube 16 remote from handle 14 is downwardly curved, as shown in FIG. 1, and flattened to define a first fixed jaw member 18. Tube 16 can be so deformed by progressive stamping operation with the tip 19 beveled to form a relatively narrow straight edge for mating with the movable jaw member 20. The second or movable jaw member 20 is pivotally mounted to tube 16 by means of a bolt 22 passing through an aperture formed transversely through tube 16 and through apertures 24 and 26 (FIGS. 2 and 3) in jaw member 20.

Figure 4:
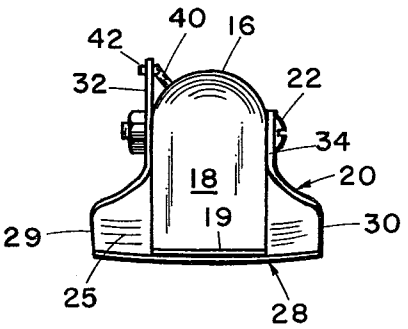
FIG. 4 is a front view of the jaw construction shown with the jaws in a closed position.
Figure 2:
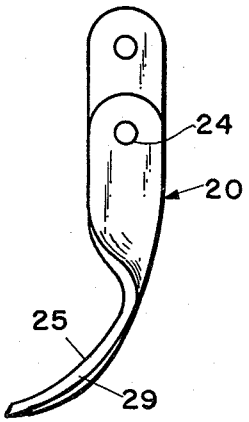
FIG. 2 is an enlarged side elevational view of the movable jaw shown in FIG. 1.

Jaw member 20 is significantly wider at its end than jaw 18. By significantly wider, it is meant that jaw 20 is at least 50 percent wider than jaw 18 at their tips. In the preferred embodiment, jaw 18 had a width of 1 15/16 inches while jaw 20 was 2 3/16 inches wide. Jaw 20 is concavely curved as best seen in FIGS. 2 and 4 to define a concave central area surface 25 forming a spoon-like member with the concave surface 25 facing fixed jaw 18. The front edge 28 of jaw 20 is curved upwardly as seen in FIG. 4 at its opposite ends as are side edges 29 and 30 (FIG. 2) The integral jaw member 20 includes extending from the opposite edges 29 and 30 a first leg 32 and a second leg 34, respectvely for mounting the pivot jaw to the tubular shank member 16 as seen in FIG. 1. Leg 32 is longer than leg 34 and includes an aperture 33 therein for receiving a hooked end 42 of a control rod 40 extending from leg 32 to a trigger mechanism 44. Trigger mechanism 44 is pivotally mounted near the handle end of shank 12 by means of a bolt 46.

The trigger mechanism 44 includes a curved trigger 45 integrally formed with a U-shaped mounting bracket 47 having a pair of legs spanning tube 12 and each including an aperture for receiving pivot bolt 46. Mechanism 44 also includes a downwardly depending leg 48 for receiving a hooked end 43 of control rod 40 therein.

Control rod 40 includes at approximately its center, an integrally formed U-shaped hook 49 for receiving a first hooked end 51 of the bias spring 50, the opposite end 52 of spring 50 extends through and over the rear edge of a slot 15 formed through the top of tube 16 permitting the control rod 40 to extend outwardly through the tube as best seen in FIG. 1. Tube 12 likewise includes a slotted aperture 13 permitting the end of control rod 40 to extend through the shank and engage the trigger mechanism 44 as seen in FIG. 1. Slots 13′ and 15 can be relatively narrow rectangular slots sufficiently wide to permit the entry and exit of the control rod without binding of the rod as it moves within the shank formed by tubes 12 and 16. Spring 50 serves to hold the control rod 40 in the position shown in FIG. 1 corresponding to the jaw open position.

Figure 3:
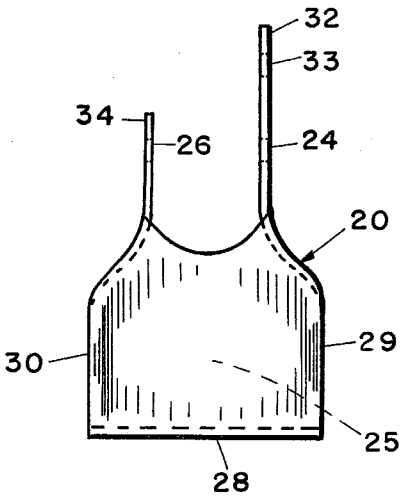
FIG. 3 is a side elevation of the jaw member shown in FIG. 2 viewed from the right in FIG. 2.

The trigger mechanism 44 as well as the movable jaw member 20 are each formed from flat stock aluminum sheets cut to define the outer boundaries of the members and subsequently stamped by a progressive die. The concavely curved lower jaw member 20 has a curved tip 28, straight sides 29 and 30 and inwardly ad upwardly formed legs 32 and 34 as best seen in FIGS. 2, 3 and 4. Similarly, the trigger mechanism 44 is formed by a progressive stamping operation to provide a relatively comfortable trigger 45 for use by the operator in moving the control rod 40 to a jaw closing position as seen in FIG. 4.

Although the tip 28 of the movable jaw member 20 is slightly curved, there is substantial mating contact between tip 19 of the flattened jaw member 18 and tip 28 such that a relatively small object can be held between the edges of the mating jaw members. Larger objects having a curved configuration will be scooped by the spoon-shaped movable jaw member to automatically center in alignment with the narrower fixed jaw member 18 when the device is operated, thereby assuring secure contact of the jaw members in holding an article to be picked up. Larger objects which are significantly wider than the movable jaw member 20 will be held against the movable jaw member by the narrower fixed jaw member such that there is in effect a three point contact with two points of contact being provided by the movable jaw member on one side and a central contact being provided by the fixed jaw member and located between the outer two contact points and on the opposite side of the article. This arrangement provides a firm and stable grip on elongated articles for which the device is used. It has, of course, any number of applications other than picking up litter and can be used whenever a person wants to extend his or her reach.

In order to permit a device to be extended or contracted in length, the device can be sold with two or more control rods 40 of differing length. Shank tubes 16 and 12 can be telescoped relative to one another a distance corresponding to the control rod provided to permit the device to be changed by substituting control rods and fitting screws 13 in different holes along tube 16. The hooked ends 42 and 43 of the rod are shaped to be easily removable from the trigger and jaw 20 for this purpose. FIG. 1 represents the maximum length of the device as seen by the fully extended tubes 12 and 16.

Thus, it can be seen that by the unique jaw construction, the pick up device of the present invention can be universally used with objects of practically any size and shape typically found as litter.

It will become apparent to those skilled in the art that various modifications to the preferred embodiment of the invention disclosed herein can be made. Thus, for example, it would be possible to provide the concavely curved jaw member as the fixed jaw member and the narrower jaw member as the movable jaw member. Such an embodiment, of course, would not take advantage of the utilization of the flattened end of tube 16 forming an integral jaw member, however. Such construction would, however, embody the basic concepts of this invention. These and other modifications of the preferred embodiment such as changes in size and material employed will, however, fall within the scope and spirit of the invention as defined by the appended claims.

The embodiments of the invention in which an exclusive property or privilege is claimed are defined as follows:

1. A pickup apparatus comprising:

an elongated tubular shank flattened and curved at one end to define a curved first jaw member extending orthogonally to the axis of said shank and terminating at a linearly extending, continuous tip edge;

a second jaw member having a width substantially greater than said first jaw member, said second jaw member including an article engaging surface concavely curved about two, mutually perpendicular axes and terminating at a linearly extending, continuous tip edge;

means for mounting said second jaw member to said shank for relative motion with respect to said first jaw member with said concavely curved surface of said second jaw member facing said first jaw member such that the tip edges of said first and second jaw members align when closed; and means coupled to said second jaw member for actuating said second jaw member for opening and closing said jaw members.

2. The apparatus as defined in claim 1 wherein said mounting means includes means for pivotally mounting said second jaw member to said one end of said shank, said shank including handle means at an opposite end.

3. The apparatus as defined in claim 2 wherein said actuating means comprises a control rod extending from said second jaw member to said opposite end of said shank near said handle means.

4. The apparatus as defined in claim 3 wherein said shank comprises a pair of different diameter tubes telescopically fitted together, each tube including an elongated aperture permitting said control rod to extend within and through said shank.

5. The apparatus as defined in claim 4 wherein said actuating means further includes a trigger mechanism pivotally coupled to said shank and coupled to an end of said control rod proximate to said handle means for moving said control rod to actuate said jaws.

6. The apparatus as defined in claim 5 and further including bias means coupled between said shank and said control rod for holding said jaws in a normally open position.

* * * * *

UNITED STATES PATENT AND TRADEMARK OFFICE

CERTIFICATE OF CORRECTION

PATENT NO. : 4,037,868

DATED : July 26, 1977

INVENTOR(S) : Robert M. Baker

It is certified that error appears in the above-identified patent and that said Letters Patent are hereby corrected as shown below:

Column 1, line 16:
"3,254,028" should be ---3,264,028---

Column 3, line 6:
"inwardly ad" should be ---inwardly and---

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*